US009226547B2

(12) United States Patent
Pitcock et al.

(10) Patent No.: US 9,226,547 B2
(45) Date of Patent: Jan. 5, 2016

(54) HEEL CHANGER APPARATUS

(71) Applicants: Erica L. Pitcock, Cape Carteret, NC (US); Jeffrey L. Doyle, Jr., Cape Carteret, NC (US)

(72) Inventors: Erica L. Pitcock, Cape Carteret, NC (US); Jeffrey L. Doyle, Jr., Cape Carteret, NC (US)

( * ) Notice: Subject to any disclaimer, the term of this patent is extended or adjusted under 35 U.S.C. 154(b) by 327 days.

(21) Appl. No.: 13/662,363

(22) Filed: Oct. 26, 2012

(65) Prior Publication Data

US 2014/0115921 A1 May 1, 2014

(51) Int. Cl.
*A43B 21/46* (2006.01)
*A43B 21/433* (2006.01)

(52) U.S. Cl.
CPC ..... *A43B 21/46* (2013.01); *A43B 21/433* (2013.01)

(58) Field of Classification Search
CPC ..... A43B 12/36; A43B 12/42; A43B 3/246; A43B 13/28; A43B 13/30
USPC ..... 36/36 A, 36 B, 36 C, 36 R, 41, 42, 100
See application file for complete search history.

(56) References Cited

U.S. PATENT DOCUMENTS

| | | | | |
|---|---|---|---|---|
| 4,219,946 | A * | 9/1980 | Baum | 36/42 |
| 4,400,893 | A * | 8/1983 | Musci | 36/24.5 |
| 4,494,323 | A * | 1/1985 | Latraverse | 36/42 |
| 4,670,996 | A * | 6/1987 | Dill | 36/42 |
| 5,347,730 | A | 9/1994 | Rodriguez Colon | |
| 5,581,910 | A * | 12/1996 | Lewis | 36/36 R |
| 5,655,317 | A * | 8/1997 | Grant | 36/134 |
| 5,675,916 | A | 10/1997 | Lewis | |
| 6,631,570 | B1 | 10/2003 | Walker | |
| 6,782,725 | B2 * | 8/2004 | Linares | 70/360 |
| 7,059,068 | B2 | 6/2006 | Magallanes et al. | |
| 7,185,448 | B2 | 3/2007 | Schupbach | |
| 7,874,083 | B1 * | 1/2011 | Tillman | 36/15 |
| 8,046,936 | B1 * | 11/2011 | Simon | 36/42 |
| 8,112,908 | B2 | 2/2012 | Visser | |
| 8,132,341 | B1 * | 3/2012 | Laramore | 36/100 |
| 2001/0052195 | A1 * | 12/2001 | Blakey | 36/100 |
| 2006/0150441 | A1 | 7/2006 | Cody, Jr. et al. | |
| 2007/0256330 | A1 | 11/2007 | Wallin et al. | |
| 2010/0101113 | A1 | 4/2010 | Paik | |
| 2010/0170113 | A1 | 7/2010 | Garza | |

OTHER PUBLICATIONS

"Height of Fashion: Interchangeable Heels Take Women From Day2Night", by D. Goodison, dated Jun. 12, 2011. http://bostonherald.com/business. 2 pgs.

* cited by examiner

*Primary Examiner* — Richale Quinn
*Assistant Examiner* — Anne Kozak

(57) ABSTRACT

In one embodiment of the invention, heel changer apparatus includes: a shoe including a shoe hole; a locking mechanism configured to removably couple a first heel to the shoe, wherein the locking mechanism includes a connector bolt; wherein the first heel includes a first connector slot; wherein the connector bolt is configured to be removably inserted into the shoe hole and into the first connector slot; and wherein the connector bolt, the shoe hole, and the first connector slot are configured to be the locking mechanism that removably couples the first heel to the shoe.

20 Claims, 16 Drawing Sheets

HEEL CHANGER APPARATUS

TECHNICAL FIELD

Embodiments of the invention relate generally to a heel changer apparatus.

BACKGROUND

The heels of each pair of shoes are commonly fixed at a given permanent height. For example, the heels in a given pair of shoes are each fixed at a given permanent height such as 1 inch. The heels of another pair of shoes are fixed at another given permanent height such as 2 inches. Other permanent heights for shoe heels are 3 inches, 4 inches, 5 inches, or another height. Other shoes are flat and have no heels.

High-heeled shoes are fashionable and attractive, and are often worn by users in important occasions such as weddings, parties, or other events. However, some users disadvantageously suffer from discomfort if they were high-heeled shoes for an extended period of time. In order to eliminate this discomfort from their feet, users may change from the high-heeled shoes to a lower-heeled shoe or a flat shoe. However, it is inconvenient or not practical for a user to bring along a second pair of shoes as the user is attending an important occasion or other event.

In order to eliminate the discomfort from the feet of users who are wearing high-heeled shoes, the users may alternatively remove theirs shoes and walk around bare footed. However, walking around bare footed is not preferable to most individuals.

Accordingly, current approaches do not provide a solution to help users eliminate the discomfort of wearing a high-heeled shoe for an extended period.

Based on the above discussion, the current technology is limited in its capabilities and suffers from at least the above constraints and deficiencies.

SUMMARY

In one embodiment of the invention, a heel changer apparatus includes: a shoe including a shoe hole; a locking mechanism configured to removably couple a first heel to the shoe, wherein the locking mechanism includes a connector bolt; wherein the first heel includes a first connector slot; wherein the connector bolt is configured to be removably inserted into the shoe hole and into the first connector slot; and wherein the connector bolt, the shoe hole, and the first connector slot are configured to be the locking mechanism that removably couples the first heel to the shoe.

In an embodiment of the invention, the apparatus may also include: a second heel including a second connector slot, wherein the locking mechanism is configured to removably couple the second heel to the shoe, wherein the connector bolt is configured to be removably inserted into the shoe hole and into the second connector slot, and wherein the connector bolt, the shoe hole and the second connector slot are configured to be a locking mechanism that removably couples the second heel to the shoe.

In an embodiment of the invention, the first heel may include a first height and the second heel may include a second height, wherein the first height differs from the second height.

In an embodiment of the invention, the first heel may include a first thickness value and the second heel may include a second thickness value, wherein the first thickness value differs from the second thickness value.

In an embodiment of the invention, the first heel may include a first shape and the second heel may include a second shape, wherein the first shape differs from the second shape.

In yet another embodiment of the invention, the heel changer apparatus further includes: a shoe; means for removably locking a first heel to the shoe, wherein the means for removably locking is configured to removably couple the first heel to the shoe.

In yet another embodiment of the invention, a method of assembling a heel changer apparatus includes: forming a shoe with a shoe hole in the sole of the shoe; forming a connector bolt; forming a heel with a connector slot; removably attaching the heel to the shoe by inserting the connector bolt into the shoe hole and into the connector slot; and turning the connector bolt into a locked setting.

It is to be understood that both the foregoing general description and the following detailed description are exemplary and explanatory only and are not restrictive of the invention, as claimed.

The accompanying drawings, which are incorporated in and constitute a part of this specification, illustrate one (several) embodiment(s) of the invention and together with the description, serve to explain the principles of the invention.

BRIEF DESCRIPTION OF THE DRAWINGS

Non-limiting and non-exhaustive embodiments of the invention are described with reference to the following figures, wherein like reference numerals refer to like parts throughout the various views unless otherwise specified. Additionally, the left-most digit of a reference number may identify the drawing in which the reference number first appears.

DETAILED DESCRIPTION OF PREFERRED EMBODIMENTS

Figure 1:
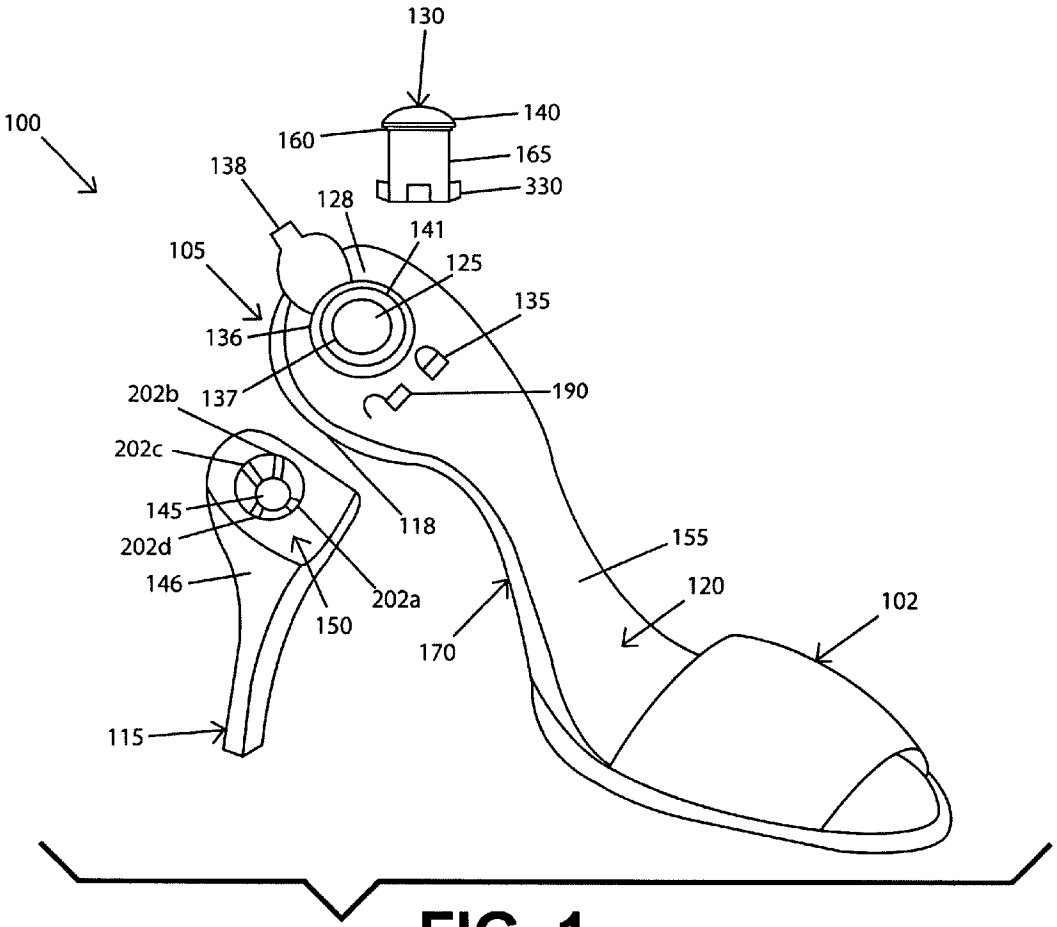
FIG. 1 is a block diagram of a heel changer apparatus, in accordance with an embodiment of the invention.

In the description herein, numerous specific details are provided, such as examples of components, materials, parts, structures, and/or methods, to provide a thorough understanding of embodiments of the invention. One skilled in the relevant art will recognize, however, that an embodiment of the invention can be practiced without one or more of the specific details, or with other apparatus, systems, methods, components, materials, parts, structures, and/or the like. In other instances, well-known components, materials, parts, structures, methods, or operations are not shown or described in detail to avoid obscuring aspects of embodiments of the invention. Additionally, the figures are representative in nature and their shapes are not intended to illustrate the precise shape or precise size of any element and are not intended to limit the scope of the invention.

Those skilled in the art will understand that when an element or part in the drawings is referred to as being "on" (or "connected" to or "coupled" to or "attached" to) another element, it can be directly on (or directly attached to) the other element or intervening elements may also be present. Furthermore, relative terms such as "inner", "outer", "upper", "above", "lower", "beneath", "below", "downward", and "upward" and similar terms, may be used herein to describe a relationship of one element relative to another element. It is understood that these terms are intended to encompass different orientations of the device in addition to the orientation depicted in the figures.

Although the terms first, second, and the like may be used herein to describe various elements, components, parts, regions, layers, chambers, and/or sections, these elements, components, parts, regions, layers, chambers, and/or sections should not be limited by these terms. These terms are only used to distinguish one element, components, part, region, layer, chamber, or section from another element, component, part, region, layer, chamber, or section. Thus, a first element, component, part, region, layer, chamber, or section discussed below could be termed a second element, component, part, region, layer, chamber, or section without departing from the teachings of the present invention.

Embodiments of the invention are described herein with reference to various illustrations (e.g., cross-sectional view illustrations, transparent view illustrations, elevational view illustrations, top view illustrations, and/or perspective view illustrations) that are schematic illustrations of representative embodiments of the invention. As such, variations from the shapes of the illustrations as a result of, for example, manufacturing techniques and/or tolerances are expected. Embodiments of the invention should not be construed as limited to the particular shapes of the elements, components, parts, regions, layers, chambers, and/or sections illustrated herein but are to include deviations in shapes that result, for example, from manufacturing or particular implementations. For example, an element illustrated or described as square or rectangular may typically have rounded or curved features due to normal manufacturing tolerances or due to a particular implementation. Thus, the elements illustrated in the figures are schematic in nature and their shapes are not intended to illustrate the precise shape of an element of a device and are not intended to limit the scope of the invention.

Based on the discussion of the embodiments of the invention as presented herein, those skilled in the art will realize that the positions and/or configurations of the components in the drawings can be varied in different sizes, different shapes, different positions, and/or different configurations. Therefore, various components shown in the drawings can be placed in other positions that differ from the configuration as shown in the drawings. The components in the drawings are illustrated in non-limiting example positions for purposes of explaining the functionalities of the embodiments of the invention, and these components in the drawings can be configured into other example positions.

FIG. 1 is a block diagram of a heel changer apparatus 100, in accordance with an embodiment of the invention. The heel changer apparatus 100 provides a shoe 102 that gives users (e.g., women) the capabilities to easily, conveniently, and quickly change the height and/or style of their shoe by being able to attach different sizes and/or types of heels to the same shoe 102. Therefore, the heel changer apparatus 100 permits the user to vary the height of a heel in a shoe 102 to any of various heights such as, by way of example and not by way of limitation, 1 inch, 2 inches, 3 inches, 4 inches, 5 inches, or another height, and also permits the user to also eliminate the heel in the shoe 102 so that the user can convert the heeled shoe into a flat shoe. Therefore, the shoe 102 can be adjusted to connect to different heel heights or can be adjusted into a flat shoe.

In an embodiment of the invention to be discussed below in further details, the heel changer apparatus 100 includes a locking mechanism 105 that is configured to removably lock (or removably connect) a heel 115 to the bottom surface 118 of the shoe sole 120 of the shoe 102. Two components are removably locked (or removably attached or removably coupled) means that two different components can be attached together or detached apart. Therefore, this heel changer apparatus 100 provides interchangeable heels of different heights (e.g., low heels, mid-heels, or high-heels) and gives users the options to change the height, style (or shape), and/or thickness of their shoe heels 115 without the need to change their shoe. The interchangeable heels 115 may vary in height, shape (or style), size, thickness, and/or color, and the locking mechanism 105 permits the user to easily swap among these interchangeable heels 115 for removable connection to the same shoe 102. For example, the heights of the interchangeable heels 115 can vary such as, for example, 1 inch, 2 inches, 3 inches, 4 inches, 5 inches, or other measurements. By being able to swap these interchangeable heels 115 for the same shoe 102, the user can have an entirely different look, style, and comfort in the same shoe 102.

The shoe 102 includes a shoe hole 125 at the top portion 128 of the shoe sole 120. The shoe hole 125 is configured to removably receive and removably secure a connector bolt 130. The sole 120 also includes (or is marked with) a lock icon 135 and an unlock icon 190. The icons 135 and 190 can be markings (e.g., ink or color markings) or separate elements that are attached on the sole 120. The icons 135 and 190 are adjacent to the shoe hole 125 and will be discussed further below. A connector bolt lip 136 surrounds the edge 137 of the shoe hole 125 and receives (or supports) the bolt top 140 of the connector bolt 130. Therefore, the connector bolt lip 136 permits the bolt top 140 to securely rest on the top 141 of the shoe hole 125.

In one embodiment of the invention, a padded flap 138 is typically coupled to the sole 120 and can be moved to cover the bolt top 140 when the bolt 130 is removably inserted into the shoe hole 125 and into connector slot 145. This connector slot 145 is on the top surface 150 of the heel 115 and within the body 146 of the heel 115. By way of example and not by way of limitation, the connector slot 145 is approximately 1 inch deep. By way of example and not by way of limitation, the padded flap 138 may be any suitable material such as a pad, a rubber, a thick cloth material, a pad typically used as a padding for a shoe, or another material that provides a cushion effect (or comfort) on the feet of the user. By way of example and not by way of limitation, the padded flap 138 can be attached to the sole 120 by stitches, adhesive, glue, or another suitable standard attachment method or suitable standard attachment mechanism.

The sole 120 is typically a stiff and yet flexible sole. A padding 155 is typically placed on the sole 120. By way of example and not by way of limitation, the padding 155 may any of the above materials that can be used for the padded flap 138.

A washer 160 is typically placed around the cylindrical portion 165 of the connector bolt 130 and under the top 140 (and adjacent to the top 140) of the bolt 130. The washer 160 is typically rubber. However, the washer 160 may be another suitable material that can be used as a washer.

Based on the discussion herein, the connector bolt 130 is configured to be removably inserted into the shoe hole 125 and into the first connector slot 145 of the first heel 115. When the connector bolt 130 is removably inserted into the shoe hole 125 and into the first connector slot 145, the bolt 130, the shoe hole 125, and the first connector slot 145 are configured to be a locking mechanism 105 that removably couples the heel 115 to the shoe 102.

As will be discussed below, in an embodiment of the invention, a second heel (e.g., removable heel 115*b* in FIG. 9) includes a second connector slot, wherein the locking mechanism is configured to removably couple the second heel to the shoe 102, wherein the connector bolt 130 is configured to be removably inserted into the shoe hole 125 and into the second connector slot, and wherein the connector bolt 130, the shoe hole 125 and the second connector slot are configured to be a locking mechanism 105 that removably couples the second heel to the shoe 102.

In an embodiment of the invention, the first heel (e.g., removable heel 115*a* in FIG. 9) includes a first height H1 and the second heel (e.g., removable heel 115*b*) includes a second height H2, wherein the first height H1 differs from the second height H2. The first height and the second height can represent any one of the heights H1 through H4 in FIG. 9 or may represent other heights.

The thickness of the connector bolt 130, depth of the shoe hole 125, depth of the connector slot 145, stiff (and sufficiently flexible) arch 170 in the sole 120, and the washer 160 (e.g., a rubber washer 160) create a connection from an interchangeable heel 115 to the sole 120 that is secure, that will not slip, and that will stand the weather and abuse encountered by shoes on a daily basis or from day-to-day life. The locking mechanism 105 (which includes the connector bolt 130) used to attach the removable heel 115 to the sole 120 (and to detach the heel 115 from the sole 120) also solves several issues and problems that are not addressed by current devices and known patent related publications. For example, current patent related publications do not address the following issues and/or do not suggest the following advantages.

First, the user can lock and unlock the locking mechanism 105 by use of a nickel or quarter (or other coin) and can swap heels within a few seconds. Therefore, the locking mechanism 105 advantageously provides a convenient heel swapping device for the user. In contrast, current products and current patents or patent publications have not address the significant time involved in their mechanisms for swapping heels.

Second, the length and thickness of the connector bolt 130 create a stable connection between the heel 115 and the sole 120. Also, the lock icon 135 helps the user to see that the heel 115 is locked in place on the shoe 102. As discussed above, the connector bolt 130, shoe slot 125, and heel connector slot 145 provide a locking mechanism 105 in accordance with an embodiment of the invention.

Third, the heel changer apparatus 100 may include a stiff (and yet suitably flexible) arch 170 in the sole 120. These characteristics advantageously create the foot support for the different angles of the height of a heel 115 after that heel 115 is swapped as a replacement on the shoe 102 for a previously removed heel.

Fourth, the rubber washer 160 attached to the connector bolt 130, in one embodiment, creates a more stable and tighter connection between the heel 115 and the sole 120 and further provides a water tight seal for the shoe 102.

Fifth, the padded flap 138 on the top portion 128 of the shoe sole 120, in one embodiment, serves at least two purposes. For example, the padded flap 138 hides the connector bolt 130 from plain sight on the shoe 102 and provides comfort due to the extra padding inside the padded flap 138.

Therefore, this locking feature of the mechanism 105 advantageously provides a user of the heel changer apparatus 100 with the ability to change the height of the heel 115 on the shoe 102 with ease and as frequently as the user desires. As a result, this locking feature eliminates the need for a user in having to carry along extra shoes during travel or during events participation and can easily adjust the heel height to fit the occasion being experienced by a user (e.g., business meetings, walking, dancing, formal dinner, and/or other events).

Figure 2:
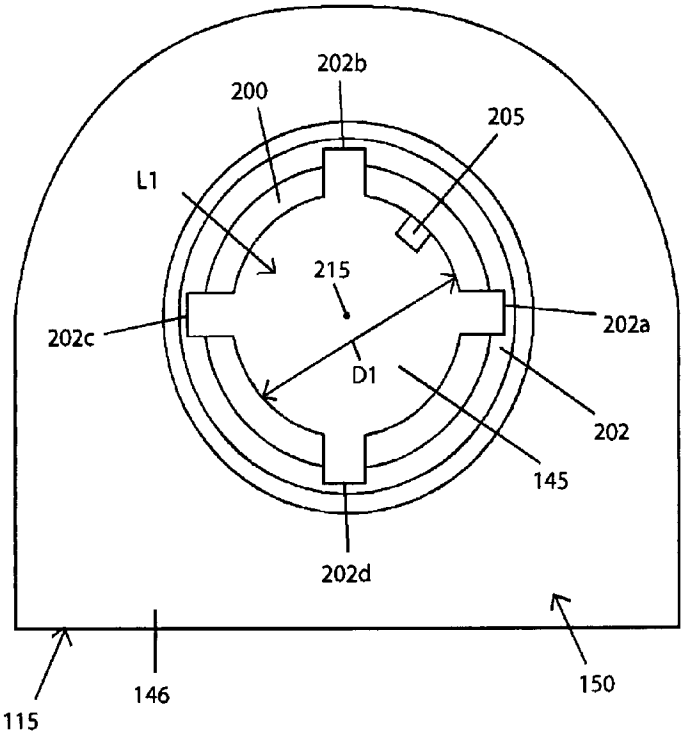
FIG. 2 is a block diagram of a removable heel as seen from a top view, in accordance with an embodiment of the invention.

FIG. 2 is a block diagram of a removable heel 115 as seen from a top view, in accordance with an embodiment of the invention. By way of example and not by way of limitation, the connector slot 145 has a length L1 (or depth L1) of approximately one inch. The value of L1 can be at other length (depth) values. For a heel 115 that is one inch (or less) in height, the length L1 is less than one inch.

The diameter D1 of the connector slot 145 may be set to any suitable value. For example, the diameter D1 is approximately 0.5 inch or another diameter value.

The connector slot 145 is surrounded by a wall 200 which is a surface within the heel body 146 of heel 115. In an embodiment of the invention, indentations 202 are configured within the wall 200. An indentation 202 is a dent (or dip) that extends into the wall 200. The number of indentations 202 may vary. In the example of FIG. 2, the indentations 202*a*, 202*b*, 202*c*, and 202*d* are configured within the wall 200 and are surrounding the connector slot 145. In an embodiment of the invention, a stopper 205 is also configured on the wall 200. The stopper 205 is an element that protrudes from the wall 200 toward the center 215 of the connector slot 145. The stopper 205 can be any durable component (e.g., metal or hard synthetic material such as hard plastic) that is molded on the wall 200 or attached to the wall 200.

Figure 3:
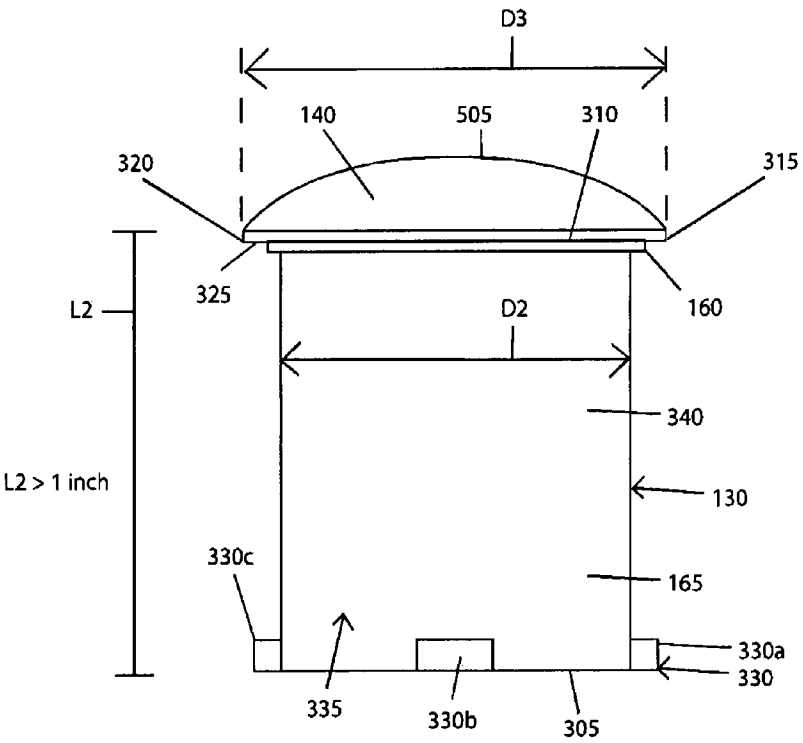
FIG. 3 is a block diagram of a connector bolt as seen from a side view, in accordance with an embodiment of the invention.

FIG. 3 is a block diagram of a connector bolt 130 as seen from a side view, in accordance with an embodiment of the invention. The washer 160 is disposed adjacent to the bolt top 140 and around the cylindrical portion 165. The cylindrical portion 165 has a length (height) L2 that can be set to various values. The length L2 extends from the cylinder bottom 305 of the cylindrical portion 165 to the cylinder top 310 of the cylindrical portion 165. The bolt top 140 is disposed on the cylinder top 310. The length L2 is greater than the length L1 (L2>L1). Therefore, if L1 is approximately one inch, then L2 is greater than one inch.

The cylindrical portion 165 has a diameter (thickness) D2 that can be set to various values. Since the cylindrical portion 165 is removably inserted into the connector slot 145, the diameter D2 of the cylindrical portion 165 is less than the diameter D1 of the connector slot 145 (i.e. D2<D1).

The bolt top 140 has a diameter D3 that extends from a bolt top edge 315 to the opposite edge 320 of the bolt top 140. The diameter D3 is greater than the diameter D2 (D3>D2) so that the lower edge 325 of the bolt top 140 can be disposed on the top 141 of the shoe hole 125. It is also understood that D2 is less in diameter value than the diameter of the shoe hole 125 so that the connector bolt 130 can be removably inserted into the shoe hole 125.

Protruding elements 330 are coupled to and are configured to protrude from the lower portion 335 of the outer surface 340 of the cylindrical portion 165. The number of protruding elements may vary. In the example of FIG. 3, the protruding elements 330*a*, 330*b*, and 330*c* are shown. Each protruding element is configured to fit and slide within any indentation 202 (FIG. 2). Generally, the number of protruding elements 330 is equal to (or less than) the number of indentations 202. The protruding elements 330 are spaced from each other so that each protruding element 330 will fit into a corresponding one of the indentations 202. The protruding elements 330 can be integral to the outer surface 340 (and formed by a mold stamp) or may be elements that are attached to the outer surface 340.

Figure 4:
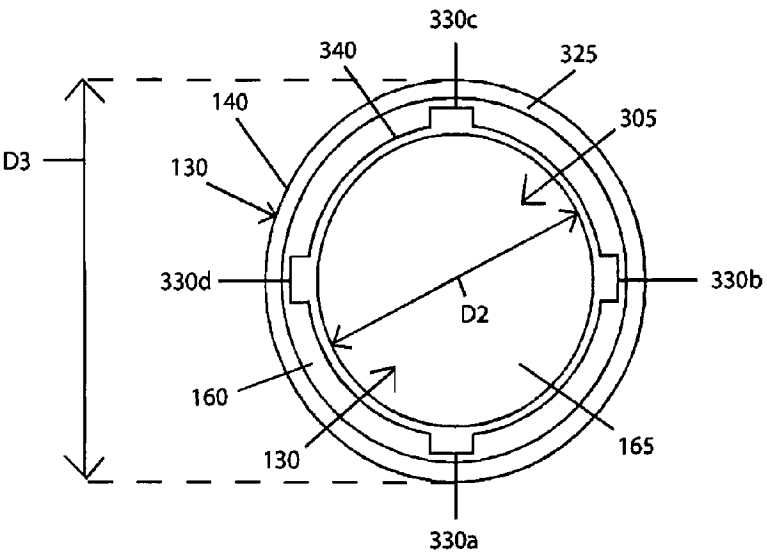
FIG. 4 is a block diagram of a connector bolt as seen from a bottom view, in accordance with an embodiment of the invention.

FIG. 4 is a block diagram of a connector bolt 130 as seen from a bottom view, in accordance with an embodiment of the invention. The protruding elements 330*a*, 330*b*, 330*c*, and 330*d* are connected to and are configured to protrude from the outer surface 340. The protruding elements 330 are spaced from each other so that the protruding elements 330*a*, 330*b*, 330*c*, and 330*d* match the positions of (and fit into) the indentations 202*a*, 202*b*, 202*c*, and 202*d*, respectively.

The washer 160 is configured to slide on the outer surface 340 of the cylindrical portion 165. The washer 160 is configured to be placed adjacent to the lower edge 325 of the bolt top 140.

Figure 5:
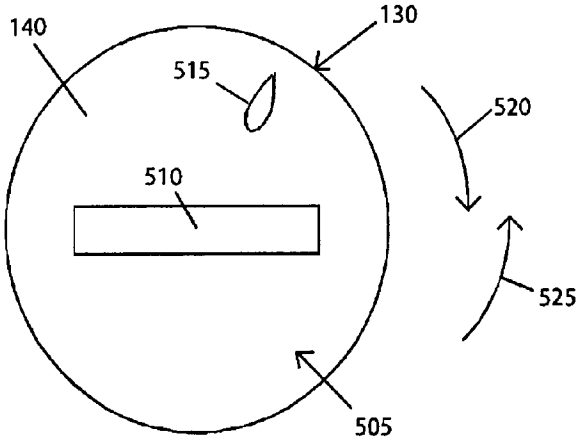
FIG. 5 is a block diagram of a connector bolt as seen from a top view, in accordance with an embodiment of the invention.

FIG. 5 is a block diagram of a connector bolt 130 as seen from a top view, in accordance with an embodiment of the invention. The bolt top 140 includes a surface 505 with an object insert area 510 and a lock/unlock indicator 515. The area 510 is an indentation in the surface 505 and is configured to receive a turning object 600 (FIG. 6A and FIG. 6B) so that the user can insert the turning object 600 into the area 510 and turn the bolt 130 in a clockwise direction 520 or a counterclockwise direction 525. The turning object 600 can be, for example, a coin such as a nickel, dime, or quarter.

The lock/unlock indicator 515 can be a marking (e.g., ink or color marking) or a separate element that is attached on the surface 505. The user turns the bolt 130 in order to line the indicator 515 with the lock icon 135 (FIG. 1) or unlock icon 190 (FIG. 1) as will be discussed further below.

Figure 6B:
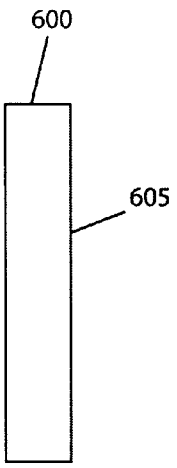
FIG. 6A and FIG. 6B are block diagrams of a turning object as seen from a front view and a side view, respectively, in accordance with an embodiment of the invention.
Figure 6A:
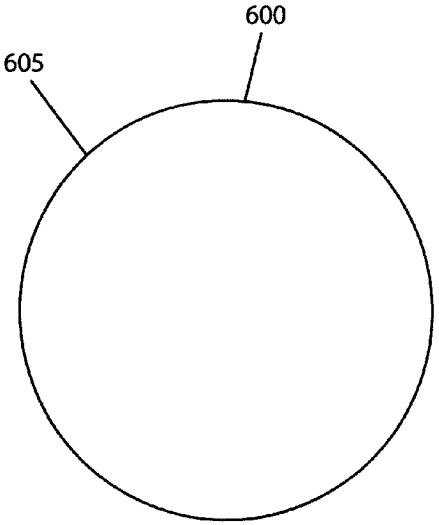

FIG. 6A and FIG. 6B are block diagrams of a turning object 600 as seen from a front view and a side view, respectively, in accordance with an embodiment of the invention. The turning object edge 605 of the turning object 600 is configured to be inserted into the area 510.

Figure 7:
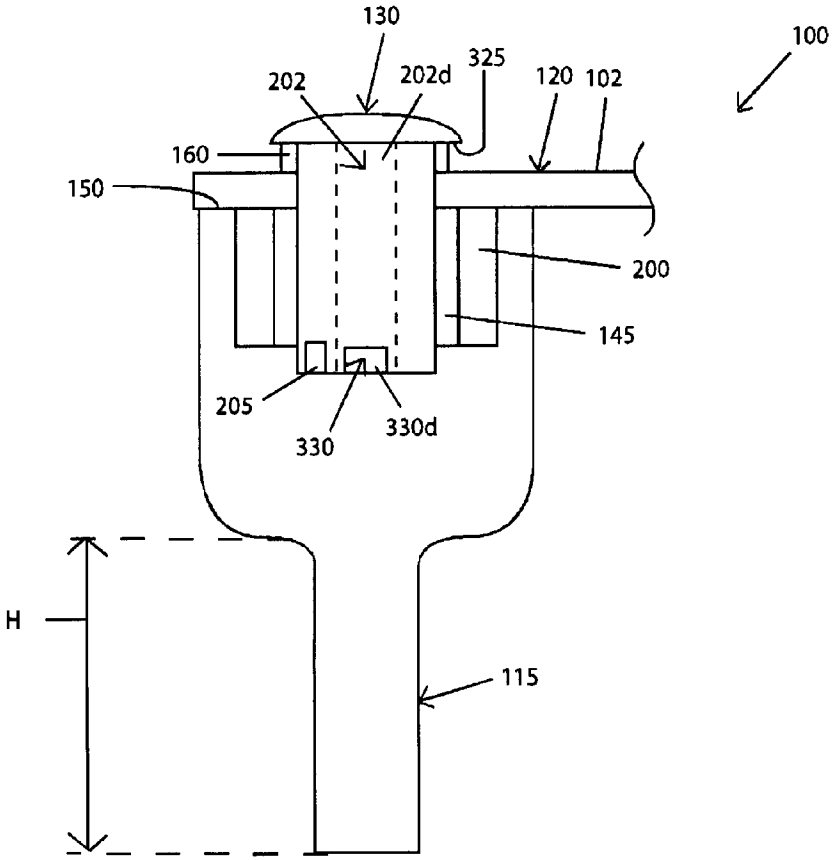
FIG. 7 is a block diagram of a heel changer apparatus, wherein the connector bolt is in an unlocked setting, in accordance with an embodiment of the invention.
Figure 8:
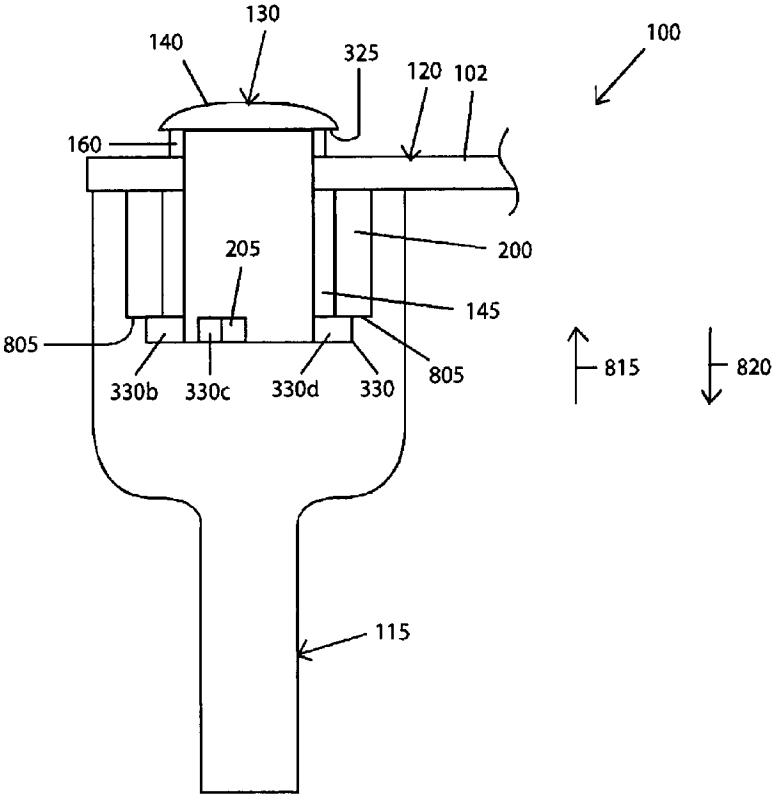
FIG. 8 is a block diagram of a heel changer apparatus, wherein the connector bolt is in a locked setting, in accordance with an embodiment of the invention.

Reference is now made to FIGS. 1 through 8. FIG. 7 is a block diagram of a heel changer apparatus 100, wherein the connector bolt 130 is in an unlocked setting, while FIG. 8 is a block diagram of the heel changer apparatus 100, wherein the connector bolt 130 is in a locked setting, in accordance with an embodiment of the invention.

Starting with the connector bolt 130 and with a heel 115 removed from the shoe 102, the user selects (chooses) a heel 115 and places the heel 115 under the sole 120 of the shoe 102. The example heel 115 is shown with a give height H. Only a portion of the sole 120 is shown in FIGS. 7 and 8. The user will line both holes (the shoe hole 125 in the sole 120 and a connector slot 145 through the top surface 150 of the heel 115) by looking from the top view of the sole 120. The user then places the connector bolt 130 inside the shoe sole 125 and connector slot 145 and lining the lock/unlock indicator 515 (FIG. 5) with the unlock icon 190 on the sole 120. In FIG. 7, when the indicator 515 is lined with the unlock icon 190, the locking device 105 (FIG. 1) is in the unlocked setting so that the bolt 130 can slide into and slide out of the hole 125 and connector slot 145, and a protruding element 330 is lined up with and slides down and within an indentation 202. For example, the protruding element 330*d* (FIG. 4) slides down and within the indentation 202*d* when the locking device 105 is in the unlocked setting. Similarly, the protruding elements 330*a*, 330*b*, and 330*c* also slide down and within the indentations 202*a*, 202*b*, and 202*c*, respectively, when the locking device 105 is in the unlocked setting. Therefore, the bolt 130 can slide down the heel female connector slot 145 because each protruding element 330 is matched with a respective indentation 202 on the wall 200 of the connector slot 145.

The user then turns the connector bolt 130 in a counterclockwise direction 525 with a quarter or nickel (or other turning object 600 in FIG. 6A and FIG. 6B) until the lock/unlock indicator 515 is pointed to the lock icon 135 and the bolt 130 is tight and secure.

In FIG. 8, when the indicator 515 is lined with the locked icon 135, the locking device 105 (FIG. 1) is in the locked setting so that the bolt 130 can not slide into and can not slide out of the hole 125 and connector slot 145, and a protruding element 330 is adjacent to the wall lower surface 805 of the wall 200. Therefore, each protruding element 330 is not lined up with and does not slide down and within an indentation 202. Therefore, the wall lower surface 805 is configured as a blocking member that blocks the protruding elements from sliding out of the connector slot 145 and shoe hole 125. When the bolt 130 tries to slide upward 815, the wall lower surface 805 will block the protruding elements 330 so that the connector bolt 130 is not able to move upward 815. When the connector bolt 130 tries to slide downward 820, the sole 120 will block the bolt top 140 of the connector bolt 130 so that the connector bolt 130 is not able to move downward 820. As a result, the heel 115 is removably coupled to the shoe 102.

After the connector bolt 130 is twisted in the counterclockwise direction 525 and the connector bolt 130 is in the locked setting because the indicator 515 is lined up with the locked icon 135, the stopper 205 also blocks the protruding element 330*c*. As a result, the connector bolt 130 is sufficiently static and is locked within the connector slot 145. By way of example only, the stopper 205 can be a snap-member that can removably receive and removably lock the protruding element 330*c* to the stopper 205. Other standard attachment mechanisms may be used to removably lock the protruding element 330*c* to the stopper 205.

FIGS. 9*a*, 9*b*, 9*c*, 9*d*, and 9*e* are block diagrams of a heel changer apparatus 100 being connected to different removable heels of different heights, in accordance with an embodiment of the invention. For example, the shoe 102 is shown as removably coupled to removable heels 115*a*, 115*b*, 115*c*, and 115*d* in FIGS. 9*a*, 9*b*, 9*c*, and 9*d*, respectively. The heels 115*a*, 115*b*, 115*c*, and 115*d* have the heights H1, H2, H3, and H4, respectively, were H1, H2, H3, and H4 differ from each other in height (length). By way of example only, the heights H1, H2, H3, and H4 are approximately 1 inch, 2 inches, 3 inches, and 4 inches, respectively. H1, H2, H3, and H4 can have other height values as well.

Figure 9A:
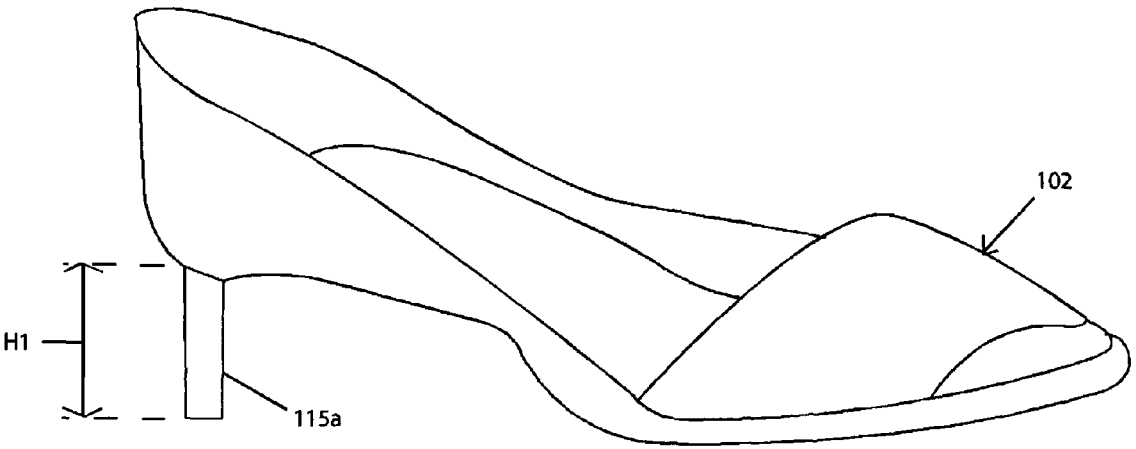
FIGS. 9*a*, 9*b*, 9*c*, 9*d*, and 9*e* are block diagrams of a heel changer apparatus being connected to different removable heels of different heights, in accordance with an embodiment of the invention.
Figure 9B:
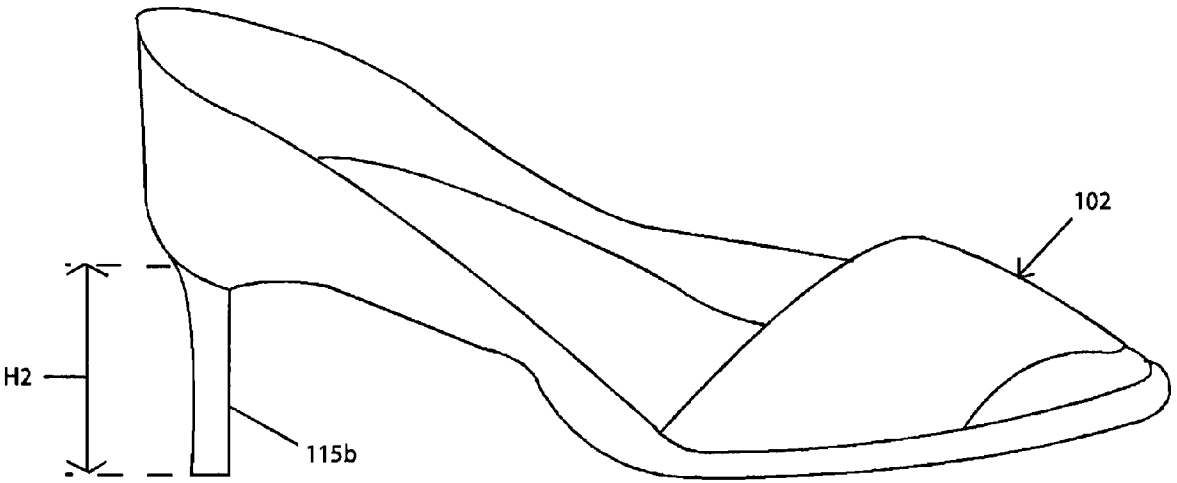
Figure 9C:
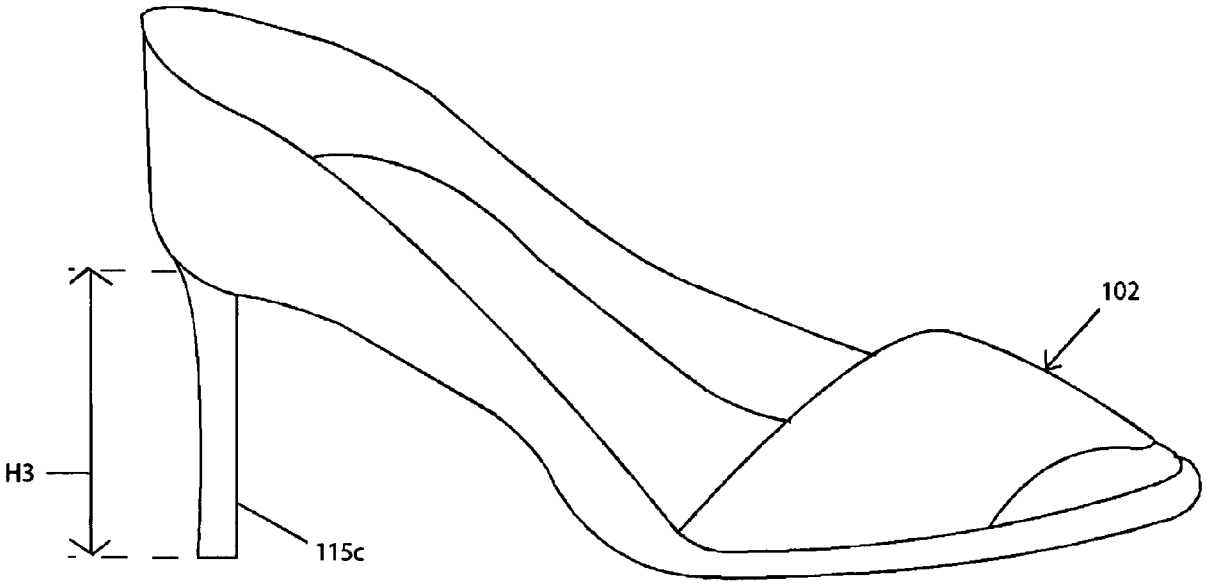
Figure 9D:
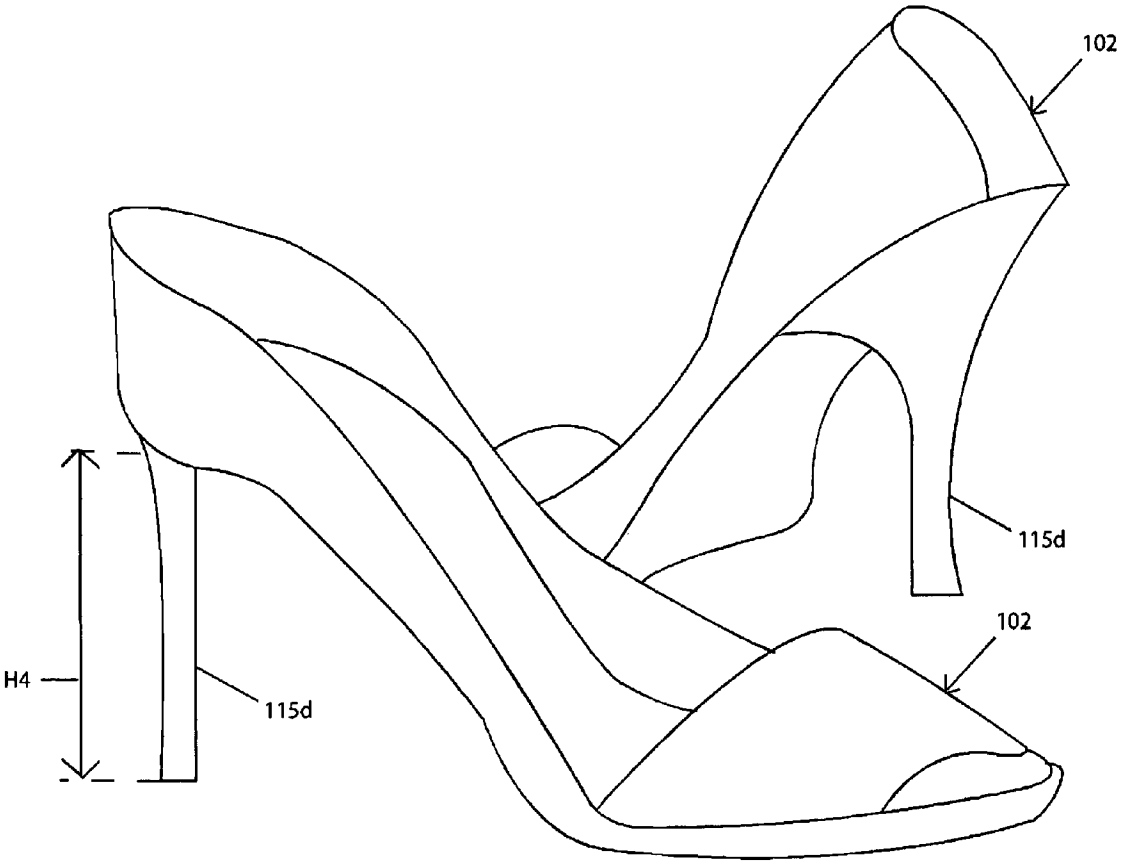
Figure 9E:
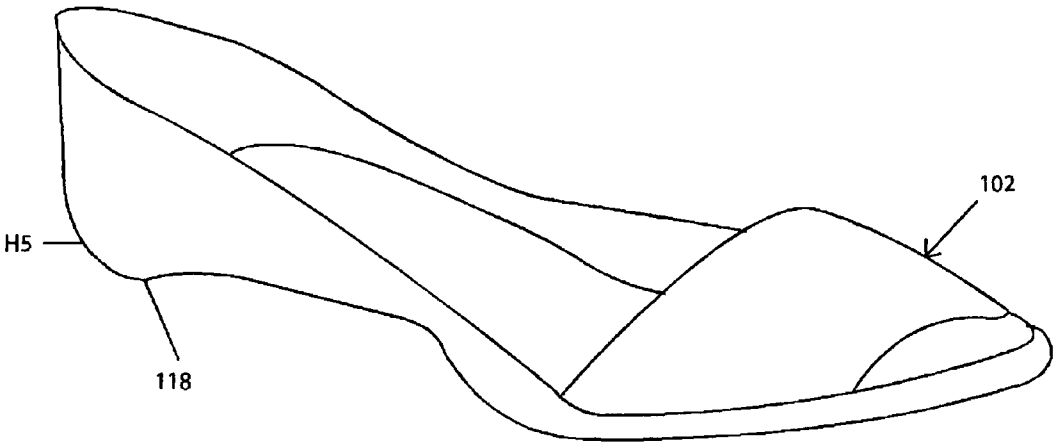

In FIG. 9*e*, a heel 115 is not attached to the shoe 102. Therefore, the shoe 102 is configured as a flat shoe if a heel 115 is not attached to the sole 120.

Figure 10B:
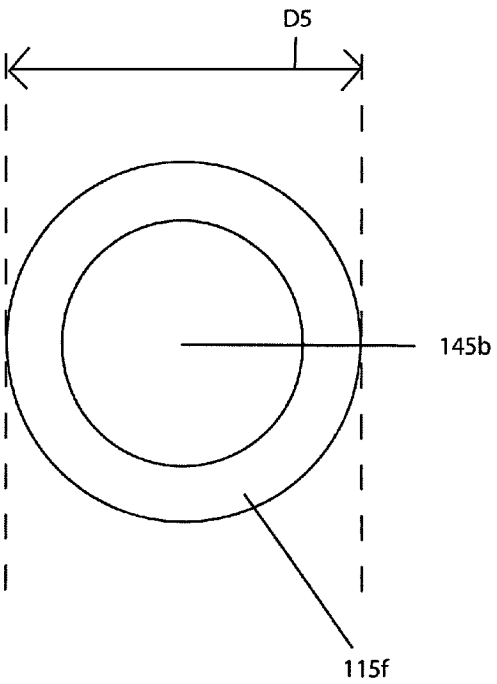
FIG. 10A and FIG. 10B are block diagrams of removable heels having different thickness values, in accordance with an embodiment of the invention.
Figure 10A:
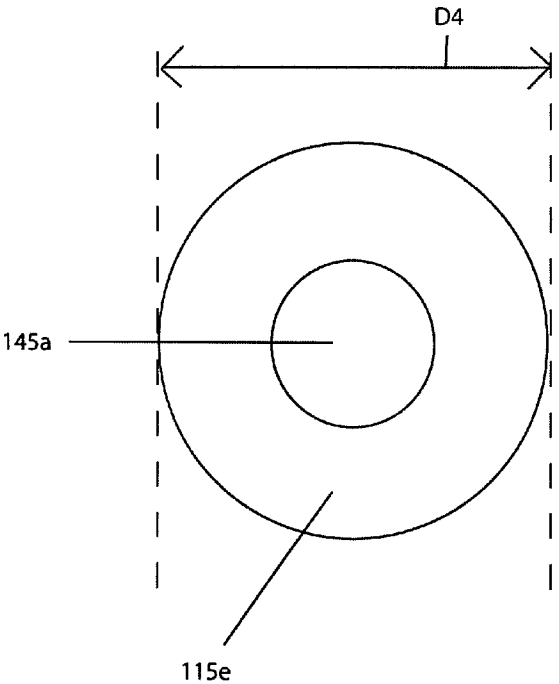

FIG. 10A and FIG. 10B are block diagrams of removable heels having different thickness values, in accordance with an embodiment of the invention. For example, a first heel 115*e* has diameter (thickness) D4 of a first thickness value and has a first connector slot 145*a*, and a second heel 115*f* has a diameter (thickness) D5 of a second thickness value and has a second connector slot 145*b*. The diameter D4 is greater than the diameter D5 (D4>D5).

Figure 11B:
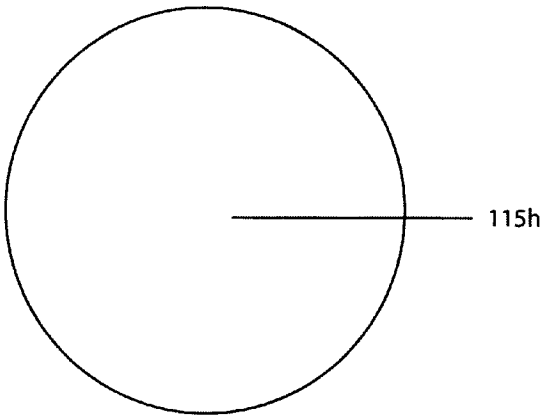
FIG. 11A and FIG. 11B are block diagrams of removable heels having different shapes, in accordance with an embodiment of the invention.
Figure 11A:
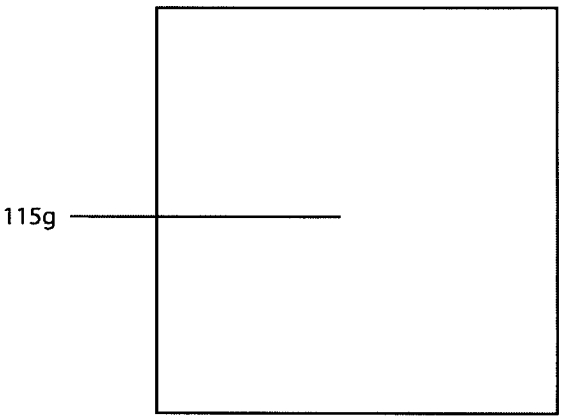

FIG. 11A and FIG. 11B are block diagrams of removable heels having different shapes, in accordance with an embodiment of the invention. For example, a first heel 115*g* has a first shape (or first style) that is square, while a second heel 115*h* has a second shape (or second style) that is circular. The shapes or styles of a heel 115 as disclosed herein may be any suitable configuration.

In an embodiment of the invention, the various components in the heel changer apparatus 100 may be formed by any suitable rigid material or semi-rigid material. For example, the connector bolt 130 may be, by way of example and not by way of limitation, metal or light-weight alloys (e.g., aluminum and/or titanium), rigid plastic, stiff rubber or stiff silicone, and/or another suitable synthetic material and/or a combination of at least some of these materials. The materials for the shoe 102 and heels 115 may be any standard materials used in shoes and/or heels.

The components in the heel changer apparatus 100 may be manufactured by standard manufacturing methods known to those skilled in the relevant art(s) such as, by way of example and not by way of limitation, molding, stamping, casting, standard attachments and assembly of individual components, and/or other standard shaping processes of durable materials.

Those skilled in the art will realize, after reading the discussion herein, that other suitable materials or combination of suitable materials can be used for the components in the heel changer apparatus 100. Those skilled in the art will also realize, after reading the discussion herein, that the assembly, manufacture, and/or construction of the components of the heel changer apparatus 100 may be selectively varied based on cost, ease of manufacturing, or/and other considerations. Additionally, the parts or components in the heel changer apparatus 100 can be suitably varied or substituted with other parts or components or shapes, as manufacturing and parts technologies improve in the future.

Figure 12:
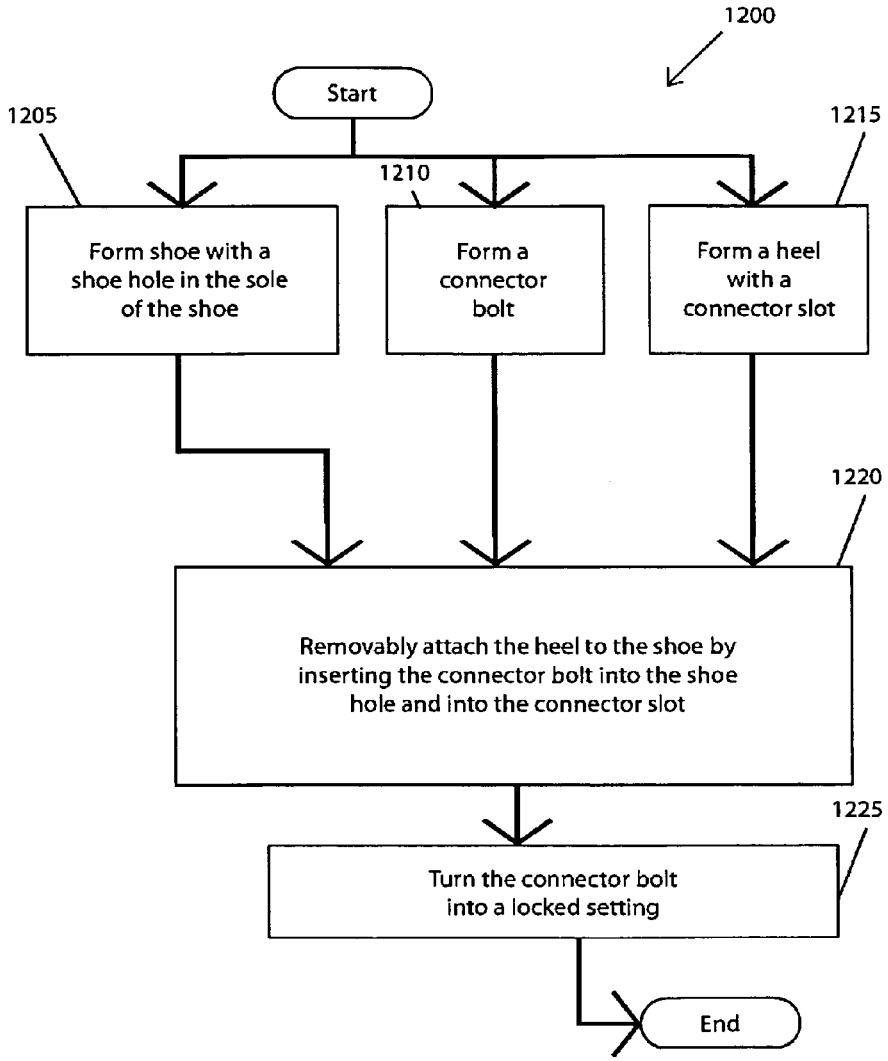
FIG. 12 is a flow diagram of a method for assembling a heel changer apparatus, in accordance with an embodiment of the invention.

FIG. 12 is a flow diagram of a method 1200 of assembling a heel changer apparatus 100, in accordance with an embodiment of the invention. The blocks in method (and/or steps in the blocks in method) may vary in order or sequence than those shown in the drawing. For example, the steps in three blocks 1205, 1210, and 1215 may be switched in sequence or order.

In block 1205, a shoe is formed with a shoe hole in the sole of the shoe. In block 1210, a connector bolt is formed. In block 1215, a heel with a connector slot is formed.

In block 1220, the heel is attached to the shoe by inserting the connector bolt into the shoe hole and into the connector slot.

In block 1225, the connector bolt is turned into a locked setting.

Additional steps in the method may be added as previously discussed above.

Other variations and modifications of the above-described embodiments and methods are possible in light of the teaching discussed herein. The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize. These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. A heel changer apparatus, comprises:

a shoe including a shoe hole and a sole;

wherein the sole includes a flexible arch;

a locking mechanism configured to removably couple a first heel to the shoe, wherein the locking mechanism includes a connector bolt;

wherein the first heel comprises a first connector slot and a heel body;

wherein the first connector slot is within the heel body and is surrounded by a wall which is a surface within the heel body;

at least a first indentation and a second indentation, wherein the first and second indentations extend into the wall, are configured within the wall, and surround the first connector slot;

wherein the first indentation comprises a first dent that extends into the wall;

wherein the second indentation comprises a second dent that extends into the wall;

a stopper configured on and attached to the wall and protruding from the wall toward a center of the first connector slot;

wherein the connector bolt comprises a cylindrical portion having a cylinder top and a bolt top on the cylinder top;

wherein the cylindrical portion comprises an outer surface, a first protruding element coupled to and configured to protrude from a lower portion of the outer surface, and a second protruding element coupled to and configured to protrude from the lower portion;

wherein the bolt top comprises a surface having an object insert area configured to receive a coin for turning the connector bolt so that the locking mechanism is in a locked setting;

wherein the bolt top comprises a lower edge;

a washer placed around the cylindrical portion, under the bolt top, and adjacent to the lower edge of the bolt top, wherein the washer provides a water tight seal for the shoe;

wherein the connector bolt is configured to be removably inserted into the shoe hole and into the first connector slot;

wherein the locking mechanism is in an unlocked setting that permits the first protruding element to slide within the first indentation and the second protruding element to slide within the second indentation as the connector bolt is removably inserted into the first connector slot;

wherein the locking mechanism is in the locked setting that removably couples the first heel to the shoe, that does not permit the first protruding element to slide within the first indentation and that does not permit the second protruding element to slide within the second indentation;

wherein the first protruding element is not lined up with the first indentation and the second protruding element is not lined up with the second indentation in the locked setting;

wherein the first and second protruding elements are adjacent to a lower surface of the wall in the locked setting;

wherein the stopper removably receives and removably locks one of the first and second protruding elements in the locked setting;

wherein the first protruding element is not within the first indentation in the locked setting;

wherein the second protruding element is not within the second indentation in the locked setting;

wherein the lower surface of the wall blocks the first and second protruding elements in the locked setting so that the lower surface blocks the connector bolt from moving upward in the locked setting while the first protruding element is not within the first indentation and the second protruding element is not within the second indentation;

wherein the sole blocks the lower edge of the bolt top in the locked setting so that the sole blocks the connector bolt from moving downward in the locked setting;

wherein the stopper comprises a durable component comprising a metal or a hard synthetic material, and wherein the durable component is molded or attached to the wall;

wherein the stopper blocks one of the first and second protruding elements in the locked setting so that the connector bolt is static within the first connector slot in the locked setting; and wherein the connector bolt, the shoe hole, and the first connector slot are configured to be the locking mechanism that removably couples the first heel to the shoe.

2. The heel changer apparatus of claim 1, further comprising:

a second heel including a second connector slot; wherein the locking mechanism is configured to removably couple the second heel to the shoe;

wherein the connector bolt is configured to be removably inserted into the shoe hole and into the second connector slot; and wherein the connector bolt, the shoe hole and the second connector slot are configured to be a locking mechanism that removably couples the second heel to the shoe.

3. The heel changer apparatus of claim 2, wherein the first heel comprises a first height and the second heel comprises a second height, and wherein the first height differs from the second height.

4. The heel changer apparatus of claim 2, wherein the first heel comprises a first thickness value and the second heel comprises a second thickness value, and wherein the first thickness value differs from the second thickness value.

5. The heel changer apparatus of claim 2, wherein the first heel comprises a first shape and the second heel comprises a second shape, and wherein the first shape differs from the second shape.

6. The heel changer apparatus of claim 1, wherein the shoe comprises a connector bolt lip surrounding the shoe hole and for receiving the bolt top.

7. The heel changer apparatus of claim 1, further comprising a padded flap that is configured to cover the connector bolt.

8. The heel changer apparatus of claim 1, wherein the washer removably receives the connector bolt.

9. The heel changer apparatus of claim 1, wherein the bolt top comprises a lock/unlock indicator;

wherein the sole comprises a lock icon and an unlock icon;

wherein the lock/unlock indicator is lined with the lock icon in the locked setting; and wherein the lock/unlock indicator is lined with the unlock icon in the unlocked setting.

10. A heel changer apparatus, comprising:

a shoe including a shoe hole and a sole;

wherein the sole includes a flexible arch; and a first means for removably locking a first heel to the shoe, wherein the first means for removably locking is configured to removably couple the first heel to the shoe;

wherein the first heel comprises a first connector slot and a heel body;

wherein the first means for removably locking comprises:

a connector bolt;

a first connector slot within the heel body and is surrounded by a wall which is a surface within the heel body;

at least a first indentation and a second indentation, wherein the first and second indentations extend into the wall, are configured within the wall, and surround the first connector slot;

wherein the first indentation comprises a first dent that extends into the wall;

wherein the second indentation comprises a second dent that extends into the wall;

a stopper configured on and attached to the wall and protruding from the wall toward a center of the first connector slot;

wherein the connector bolt comprises a cylindrical portion having a cylinder top and a bolt top on the cylinder top;

wherein the cylindrical portion comprises an outer surface, a first protruding element coupled to and configured to protrude from a lower portion of the outer surface, and a second protruding element coupled to and configured to protrude from the lower portion;

wherein the bolt top comprises a surface having an object insert area configured to receive a coin for turning the connector bolt so that the first means is in a locked setting;

wherein the bolt top comprises a lower edge;

a washer placed around the cylindrical portion, under the bolt top, and adjacent to the lower edge of the bolt top, wherein the washer provides a water tight seal for the shoe;

wherein the connector bolt is configured to be removably inserted into the shoe hole and into the first connector slot;

wherein the first means is in an unlocked setting that permits the first protruding element to slide within the first indentation and the second protruding element to slide within the second indentation as the connector bolt is removably inserted into the first connector slot;

wherein the first means is in the locked setting that removably couples the first heel to the shoe, that does not permit the first protruding element to slide within the first indentation and that does not permit the second protruding element to slide within the second indentation;

wherein the first protruding element is not lined up with the first indentation and the second protruding element is not lined up with the second indentation in the locked setting;

wherein the first and second protruding elements are adjacent to a lower surface of the wall in the locked setting;

wherein the stopper removably receives and removably locks one of the first and second protruding elements in the locked setting;

wherein the first protruding element is not within the first indentation in the locked setting;

wherein the second protruding element is not within the second indentation in the locked setting;

wherein the lower surface of the wall blocks the first and second protruding elements in the locked setting so that the lower surface blocks the connector bolt from moving upward in the locked setting while the first protruding element is not within the first indentation and the second protruding element is not within the second indentation;

wherein the sole blocks the lower edge of the bolt top in the locked setting so that the sole blocks the connector bolt from moving downward in the locked setting;

wherein the stopper comprises a durable component comprising a metal or a hard synthetic material, and wherein the durable component is molded or attached to the wall;

wherein the stopper blocks one of the first and second protruding elements in the locked setting so that the connector bolt is static within the first connector slot in the locked setting.

11. The heel changer apparatus of claim 10, further comprising: a second heel; and a second means for removably locking the second heel to the shoe, wherein the second means for removably locking is configured to removably couple the second heel to the shoe.

12. The heel changer apparatus of claim 11, wherein the first heel comprises a first height and the second heel comprises a second height, and wherein the first height differs from the second height.

13. The heel changer apparatus of claim 11, wherein the first heel comprises a first thickness value and the second heel comprises a second thickness value, and wherein the first thickness value differs from the second thickness value.

14. The heel changer apparatus of claim 11, wherein the first heel comprises a first shape and the second heel comprises a second shape, and wherein the first shape differs from the second shape.

15. The heel changer apparatus of claim 10, wherein the shoe comprises a connector bolt lip surrounding the shoe hole and for receiving the bolt top.

16. The heel changer apparatus of claim 10, further comprising a padded flap that is configured to cover the first means.

17. The heel changer apparatus of claim 10, the washer removably receives the connector bolt.

18. The heel changer apparatus of claim 10, wherein the bolt top comprises a lock/unlock indicator;

wherein the sole comprises a lock icon and an unlock icon;

wherein the lock/unlock indicator is lined with the lock icon in the locked setting; and wherein the lock/unlock indicator is lined with the unlock icon in the unlocked setting.

19. A method of assembling a heel changer apparatus, the method comprising:

providing a shoe with a shoe hole in a sole of the shoe;

providing a connector bolt;

providing a heel with a connector slot;

removably attaching the heel to the shoe by inserting the connector bolt into the shoe hole and into the connector slot; and turning the connector bolt into a locked setting;

wherein the heel comprises a connector slot and a heel body;

wherein the connector slot is within the heel body and is surrounded by a wall which is a surface within the heel body;

at least a first indentation and a second indentation, wherein the first and second indentations extend into the wall, are configured within the wall, and surround the first connector slot;

wherein the first indentation comprises a first dent that extends into the wall;

wherein the second indentation comprises a second dent that extends into the wall;

a stopper configured on and attached to the wall and protruding from the wall toward a center of the first connector slot;

wherein the connector bolt comprises a cylindrical portion having a cylinder top and a bolt top on the cylinder top;

wherein the cylindrical portion comprises an outer surface, a first protruding element coupled to and configured to protrude from a lower portion of the outer surface, and a second protruding element coupled to and configured to protrude from the lower portion;

wherein the bolt top comprises a surface having an object insert area configured to receive a coin for turning the connector bolt so that the connector bolt is in the locked setting;

wherein the bolt top comprises a lower edge;

a washer placed around the cylindrical portion, under the bolt top, and adjacent to the lower edge of the bolt top, wherein the washer provides a water tight seal for the shoe;

wherein the connector bolt is configured to be removably inserted into the shoe hole and into the first connector slot;

wherein the connector bolt is in an unlocked setting that permits the first protruding element to slide within the first indentation and the second protruding element to slide within the second indentation as the connector bolt is removably inserted into the first connector slot;

wherein the locking mechanism is in a locked setting that removably couples the first heel to the shoe, that does not permit the first protruding element to slide within the first indentation and that does not permit the second protruding element to slide within the second indentation;

wherein the first protruding element is not lined up with the first indentation and the second protruding element in not lined up with the second indentation is the locked setting;

wherein the first and second protruding elements are adjacent to a lower surface of the wall in the locked setting;

wherein the stopper removably receives and removably locks one of the first and second protruding elements in the locked setting;

wherein the first protruding element is not within the first indentation in the locked setting;

wherein the second protruding element is not within the second indentation in the locked setting;

wherein the lower surface of the wall blocks the first and second protruding elements in the locked setting so that the lower surface blocks the connector bolt from moving upward in the locked setting while the first protruding element is not within the first indentation and the second protruding element is not within the second indentation;

wherein the sole blocks the lower edge of the bolt top in the locked setting so that the sole blocks the connector bolt in moving downward from the locked setting;

wherein the stopper comprises a durable component comprising a metal or a hard synthetic material, and wherein the durable component is molded or attached to the wall;

wherein the stopper blocks one of the first and second protruding elements in the locked setting so that the connector bolt is static within the first connector slot in the locked setting.

20. The method of claim 19, wherein the bolt top comprises a lock/unlock indicator;

wherein the sole comprises a lock icon and an unlock icon;

wherein the lock/unlock indicator is lined with the lock icon in the locked setting; and wherein the lock/unlock indicator is lined with the unlock icon in the unlocked setting.

* * * * *